US008232492B1

(12) United States Patent
Davis et al.

(10) Patent No.: US 8,232,492 B1
(45) Date of Patent: Jul. 31, 2012

(54) ELECTRONICALLY BALANCED ILLUMINATED PANEL

(75) Inventors: Joshua V. Davis, Marion, IA (US); William G. Perreault, Cedar Rapids, IA (US); Steven W. Kramer, Center Point, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 695 days.

(21) Appl. No.: 12/286,066

(22) Filed: Sep. 26, 2008

(51) Int. Cl.
*H01H 9/00* (2006.01)

(52) U.S. Cl. ..... 200/314; 200/315

(58) Field of Classification Search ..... 200/310–316, 200/341–345
See application file for complete search history.

(56) References Cited

U.S. PATENT DOCUMENTS

| | | | | |
|---|---|---|---|---|
| 6,664,489 | B2 * | 12/2003 | Kleinhans et al. | 200/313 |
| 6,743,993 | B1 * | 6/2004 | Clark et al. | 200/314 |
| 6,965,086 | B2 * | 11/2005 | Suzuki et al. | 200/345 |
| 7,193,170 | B2 * | 3/2007 | Katayama et al. | 200/314 |
| 7,222,985 | B2 * | 5/2007 | Henoch | 362/196 |
| 7,244,898 | B2 * | 7/2007 | Kim | 200/314 |
| 7,265,307 | B2 * | 9/2007 | Miyasaka et al. | 200/314 |

* cited by examiner

*Primary Examiner* — Elvin G Enad
*Assistant Examiner* — Lisa Klaus
(74) *Attorney, Agent, or Firm* — Donna P. Suchy; Daniel M. Barbieri

(57) ABSTRACT

A keypanel assembly includes a light-emitting diode (LED) attached to a substrate. A switch is attached to the substrate. A control button is configured to actuate the switch. The control button permits light from the LED to pass through the control button to an outer surface of the control button to illuminate control symbology disposed thereon. An isolating structure ensures light emitted by the LED only illuminates the control symbology on the control button.

10 Claims, 4 Drawing Sheets

ELECTRONICALLY BALANCED ILLUMINATED PANEL

FIELD OF THE INVENTION

The present invention relates generally to the field of displays, and more particularly, to the control of lighting output within illuminated panels associated with backlit displays.

BACKGROUND OF THE INVENTION

Light balancing within a high performance avionics or ground vehicle keypanel or control panel is a very challenging and labor intensive process. Backlit symbology elements within an illuminated panel vary in emission intensity due to variation in materials, paints, filters and shared light sources. FIG. 1 depicts a portion of a known keypanel assembly 10. A plurality of switches 14*a*, 14*b*, 14*c* are mounted on a printed wiring board 12. A plurality of lighting sources 18*a*, 18*b* are mounted upon printed wiring board 12. A filter 20, which may be a night vision (NVIS) filter or a color filter, is disposed to filter the light produced by each lighting source 18*a*, 18*b*. A common backlighting waveguide 16 accepts light passing through the filters. A plurality of control buttons 22*a*, 22*b*, 22*c* are mounted in a chassis 26 and are each configured to operationally contact one of the switches 14*a*, 14*b*, 14*c*. Each control button has symbology 24 placed upon its outer surface. Light from the common backlighting waveguide 16 passes through each control button to illuminate the symbology placed thereon.

With a plurality of light sources emitting light into a common backlighting waveguide, it can be difficult to ensure each of the plurality of control buttons is appropriately and equally lighted. This is especially true where there is a natural variance in the intensity of light emitted by the light sources. The resultant process of balancing the light outputs in a keypanel assembly can be difficult. Known light balancing techniques rely on a very labor intensive iterative process of manually adjusting the luminance of individual light sources using white paint and black ink. This process has low repeatability as it relies on highly variable operator skill and judgment. This process is inherently re-work intensive with factory product often stranded in various states of assembly, disassembly and modification.

More recent innovation has utilized light-emitting diodes (LEDs), microcontrollers, and LED driver chips to create internally adjustable illuminated panels. The focus of these innovations has been to standardize display outputs by initially calibrating the total lighting output of a display to a common output standard, and subsequently synchronizing the dimming of the LEDs using pulse-width modulation techniques. These prior solutions, however, do not address luminance variation within a single display. The keypanel construction shown in FIG. 1, which uses shared light sources and a common waveguide with no isolation techniques employed, cannot be electronically balanced even with independently controlled light sources since no provisions have been made to optically isolate discrete symbol groups, as the backlit system remains coupled. For example, an output adjustment on light source 18*a* made to adjust measured intensity of symbology on control button 22*a* also affects measured symbology output on control button 22*b*, and to a lesser extent, control button 22*c*. This optical system is coupled and complex and must ultimately be balanced using manual touch-up techniques.

It is therefore an object of the invention to eliminate time-consuming, expensive manual touch-up processes to achieve light balancing in an illuminated panel.

Another object of the invention is to provide backlighting for an illuminated panel that can use efficient, automated post-manufacturing light balancing techniques.

A feature of the invention is the technique of packaging isolated and independently controlled backlighting subsystems for illumination of discrete symbols or symbol groups.

An advantage of the invention is elimination of the need for time-consuming, costly, and non-uniform manual light balancing processes.

SUMMARY OF THE INVENTION

The invention provides a keypanel assembly. A light-emitting diode (LED) is attached to a substrate. A switch is attached to the substrate. A control button is configured to actuate the switch. The control button permits light from the LED to pass through the control button to an outer surface of the control button to illuminate control symbology disposed thereon. An isolating structure ensures light emitted by the LED only illuminates the control symbology on the control button.

The invention also provides a keypanel assembly. First and second light-emitting diodes (LEDs) are attached to a printed wiring board. First and second switches are attached to the printed wiring board. A first control button is configured to actuate the first switch. The first control button permits light from the first LED to pass through the first control button to an outer surface of the first control button to illuminate control symbology disposed thereon. A second control button is configured to actuate the second switch. The second control button permits light from the second LED to pass through the second control button to an outer surface of the second control button to illuminate control symbology disposed thereon. An isolating structure prevents light emitted by the second LED from illuminating control symbology on the first control button. The isolating structure further prevents light emitted by the first LED from illuminating control symbology on the second control button.

The invention further provides a method of manufacturing a keypanel assembly. According to the method, first and second light-emitting diodes (LEDs) are secured to a printed wiring board. First and second switches are attached to the printed wiring board A first control button is configured to actuate the first switch. The first control button permits light from the first LED to pass through the first control button to an outer surface of the first control button to illuminate control symbology disposed thereon. A second control button is configured to actuate the second switch. The second control button permits light from the second LED to pass through the second control button to an outer surface of the second control button to illuminate control symbology disposed thereon. Light emitted by the second LED is prevented from illuminating control symbology on the first control button. Light emitted by the first LED is prevented from illuminating control symbology on the second control button.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE DRAWINGS

Reference will now be made in detail to the presently preferred embodiments of the invention, examples of which are illustrated in the accompanying drawings. It is to be appreciated that corresponding reference numbers refer to generally corresponding structures.

Figure 1:
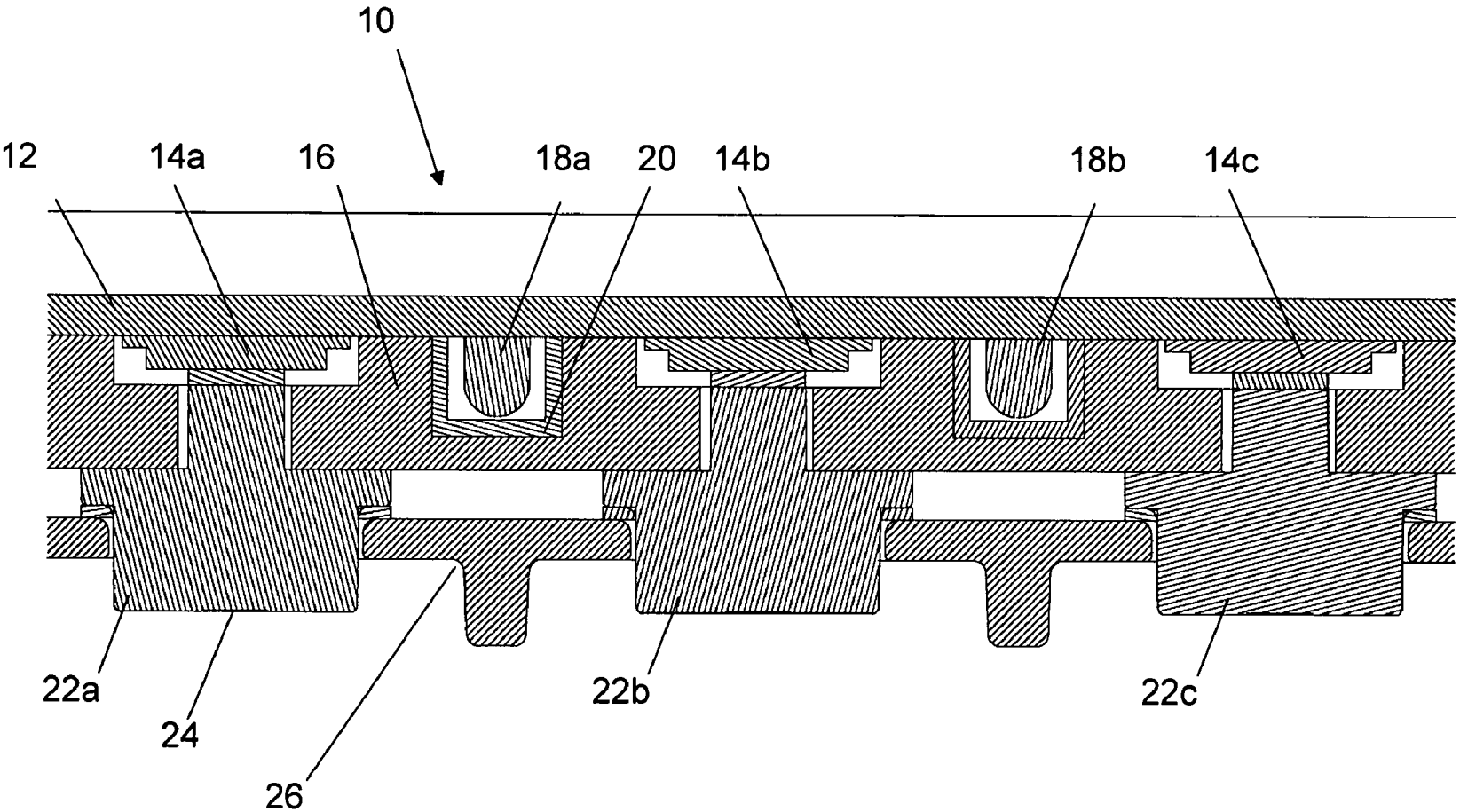
Figure 1 Prior Art
FIG. 1 is a cross-section of a portion of a keypanel according to known assembly techniques.
Figure 2:
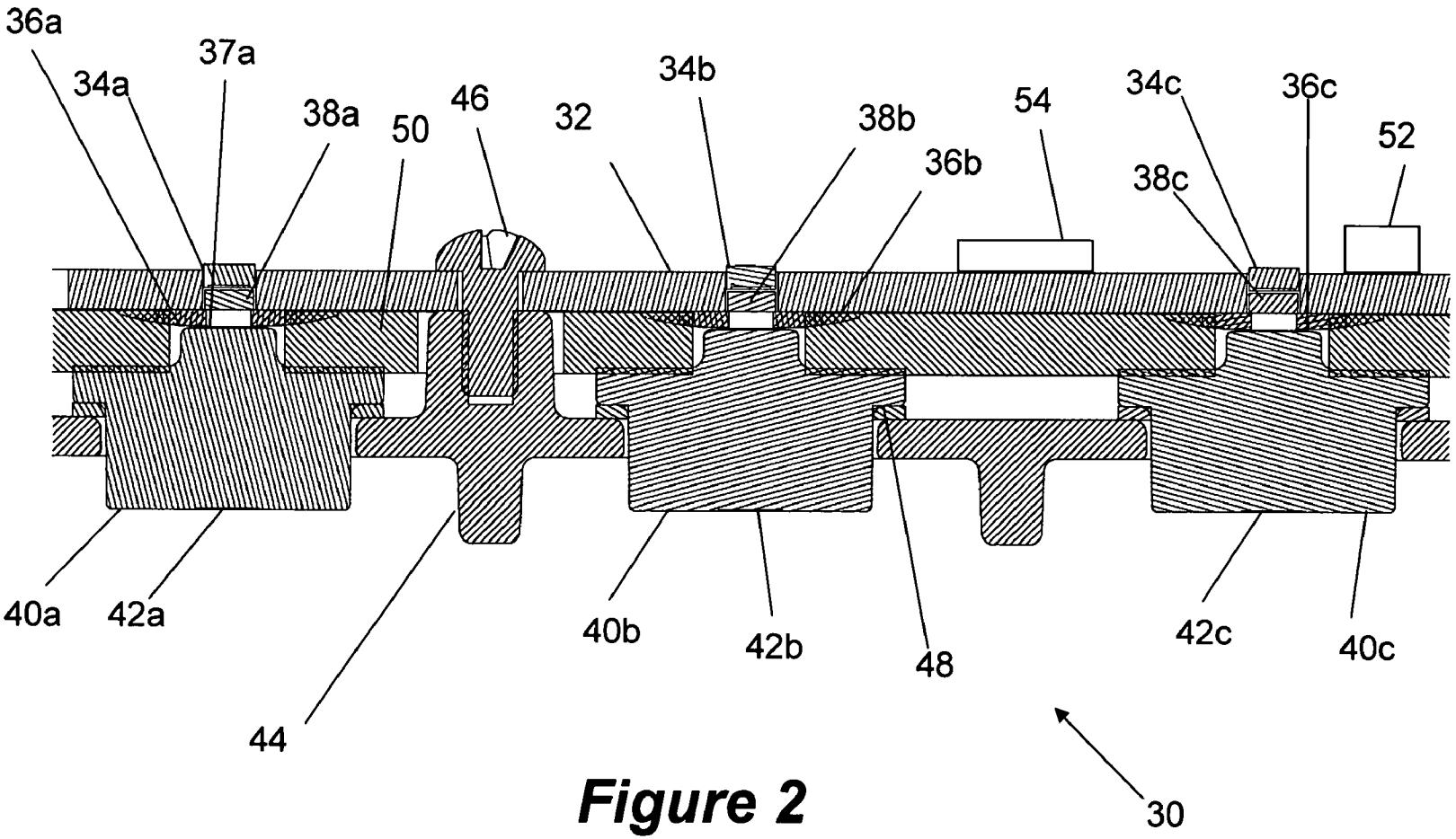
FIG. 2 is a cross-section of a portion of a keypanel according to the invention.

FIG. 2 depicts a portion of a keypanel assembly 30 according to the invention. A plurality of light-emitting diodes (LEDs) 34*a*, 34*b*, 34*c* are mounted on a substrate such as a printed wiring board 32. Switches 36*a*, 36*b*, 36*c* are also mounted on the printed wiring board and over the LEDs so that light can pass through the switches. This may be accomplished by employing a switch having an aperture 37*a* through which light may pass in an unobstructed manner. Filters 38*a*, 38*b*, 38*c*, which may be night vision filters (NVIS) or color filters as desired, are placed between LEDs 34*a*, 34*b*, 34*c* and switches 36*a*, 36*b*, 36*c* to ensure proper spectral characteristics and chromaticity of light output by the LEDs. Light from the LEDs passes through the filters and the switches and through control buttons 40*a*, 40*b*, 40*c*, each of which are constructed so that light can pass therethrough to illuminate symbology 42*a*, 42*b*, 42*c* disposed upon an outer surface of the switch. A chassis 44 is attached to printed wiring board 32 by means of attaching means such as screws 46. Control buttons 40*a*, 40*b*, 40*c* are thereby held between the chassis and the printed wiring board. A light leak gasket 48 is disposed between the chassis and the control buttons and prevents light from leaking out therebetween.

A substantially opaque backlight isolation gasket 50 is disposed between printed wiring board 32 and each of the switches. The backlight isolation gasket has openings corresponding to the LEDs and the switches so that light can pass through to the control buttons. However, the backlight isolation gasket prevents light from passing to other parts of the keypanel assembly. In this manner, the light emitted by each LED is restricted to lighting the symbology on a specific control button.

The brightness of each LED is controlled by an LED driver 52, which is under the control of a microcontroller 54. Using known techniques, LED driver 52 and microcontroller 54 can achieve key-by-key luminance balancing. With this approach, light balancing can performed from a computer (not shown) attached to microprocessor 54, with product fully assembled.

The invention may be varied in many ways while keeping with the spirit of the invention. Various localized backlight packaging methods may be employed in this general approach. A direct view approach, which as shown in FIG. 2 positions an LED directly behind the control button—or other backlit panel insert area—it is designed to illuminate, is the most practical because of its structural simplicity.

However, indirect backlighting and associated packaging techniques may also be used to address light balancing where the direct view approach encounters obstacles. Such obstacles might take the form of uniformity limitations given the switch aperture size functionally allowable in the aperture-type switch given the breadth of the symbology area to be backlit. Another obstacle might be the customer specified performance of the switch. Packaging space limitations combined with exceptional or unique performance requirements for the switch may preclude the use of an aperture-type switch in certain applications. An example of this may be the alphanumeric symbols on a rocker key where complicating factors such as switch proximity or backlit element asymmetry combine with unusual key geometry to create obstructions or suboptimal positioning for direct view sources.

Figure 3:
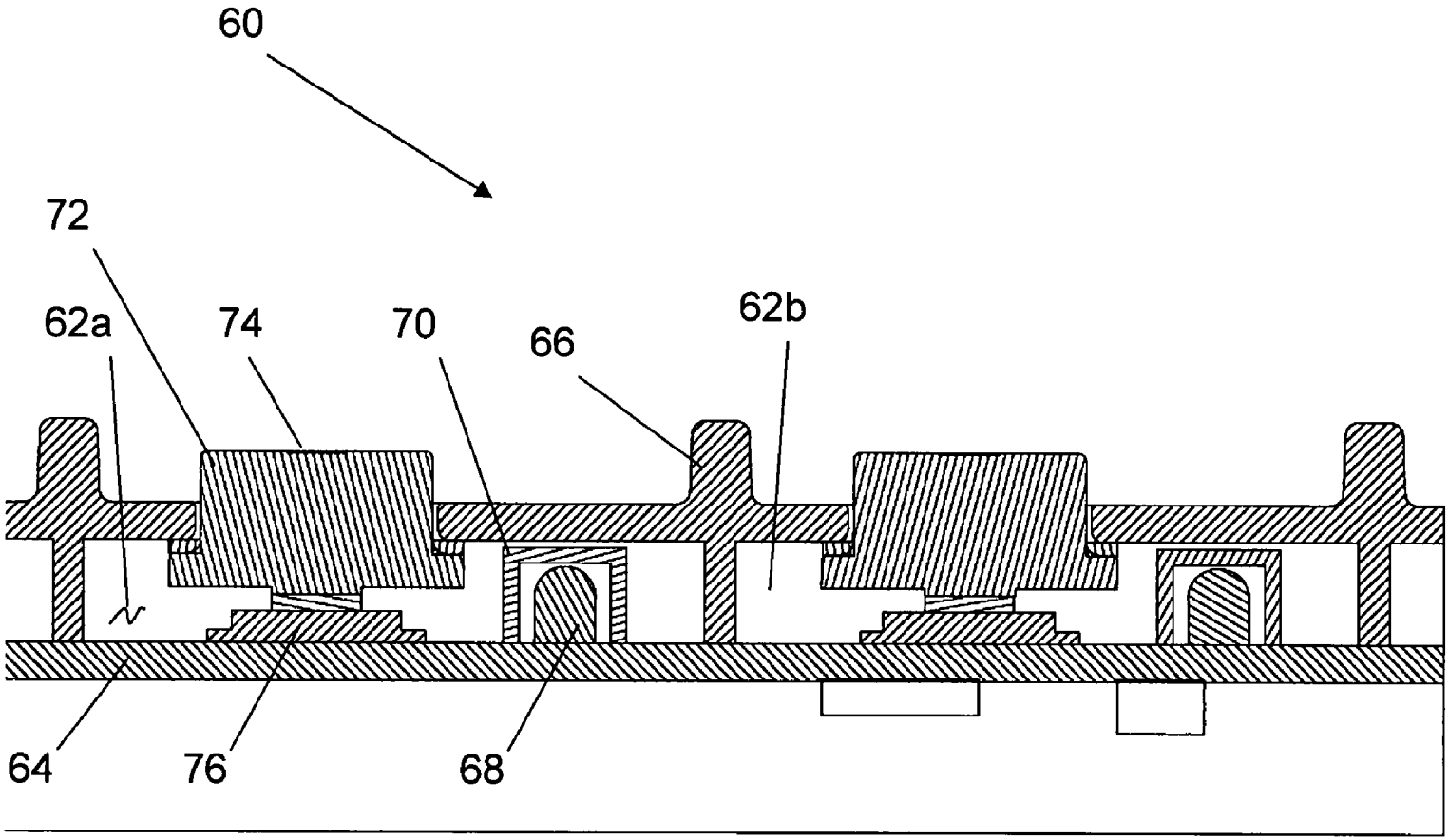
FIG. 3 is a cross-section of a portion of a keypanel according to another embodiment of the invention.

FIG. 3 depicts another embodiment of the invention that overcomes such obstacles by using an indirect lighting strategy. Keypanel assembly 60 employs the use of light-tight luminaire cavities 62*a*, 62*b* defined by printed wiring board 64 and chassis 66. One or more LEDs 68, with associated filter 70 as previously described, are mounted on printed wiring board 64 within luminaire 62*a*. Light from LED 68 reflects within luminaire 62*a* until it enters control button 72 and illuminates the symbology 74 thereon. Control button 72 is operationally connected to a switch 76 mounted on printed wiring board 64.

Figure 4:
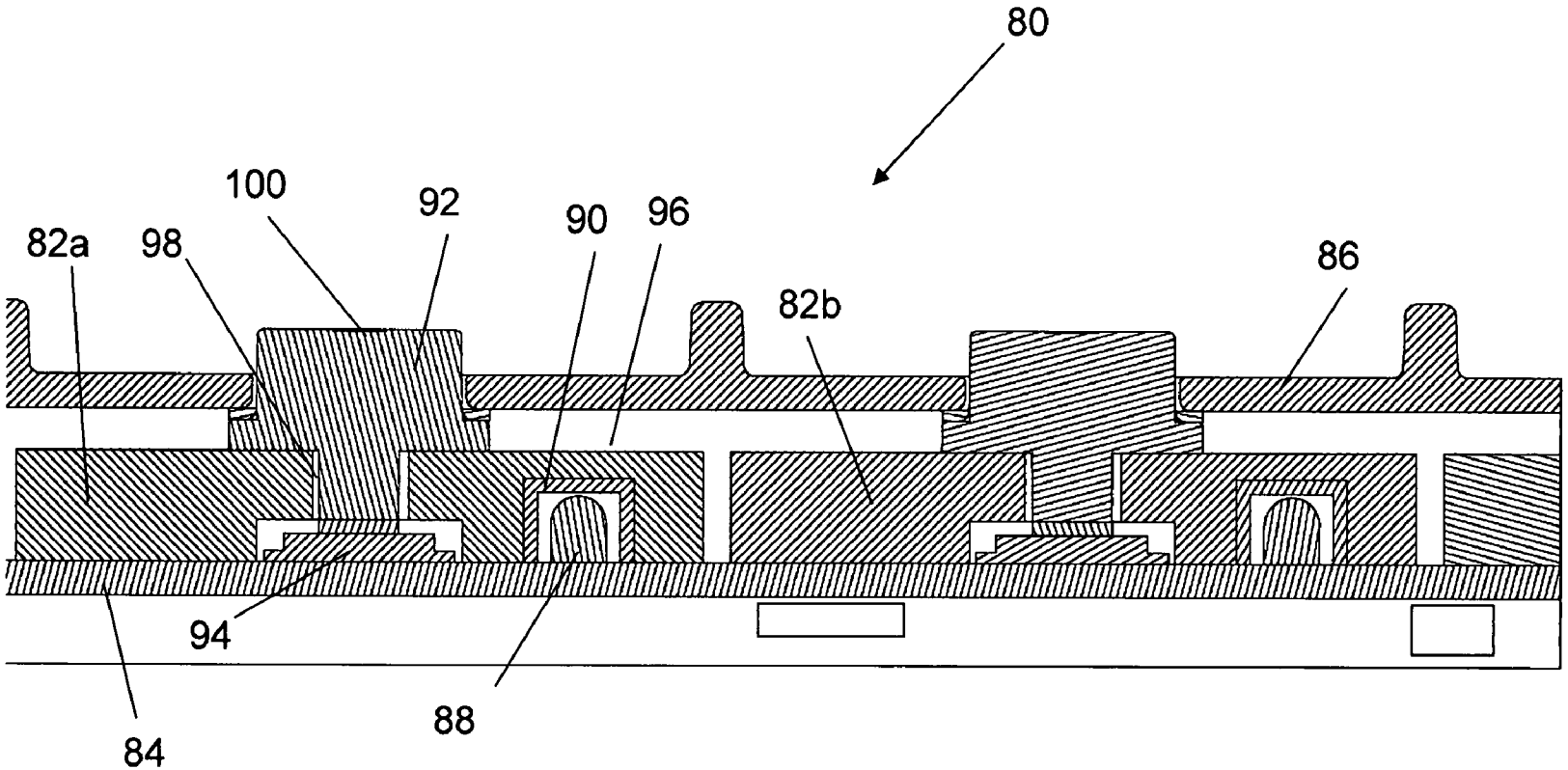
FIG. 4 is a cross-section of a portion of a keypanel according to still another embodiment of the invention.

FIG. 4 shows still another embodiment of the invention using an indirect lighting strategy. Keypanel assembly 80 includes a plurality of dedicated waveguide components 82*a*, 82*b* disposed between printed wiring board 84 and a chassis 86. The dedicated waveguide components can be completely separate from each other, or can be manufactured as a single element connected by relatively small portions of material having little effect on light transmission between connected waveguide components. Each dedicated waveguide component is made of a solid, flexible or semi-flexible material and is shaped to fit over one or more LEDs 88 (and associated filters 90). An opening in each dedicated waveguide component permits part of a control button 92 to operationally connect with a switch 94 mounted on the printed wiring board. The outer surface 96 of each dedicated waveguide component not contacted by control button 92 is painted white to ensure total internal reflection of light from LED 88 inside the dedicated waveguide component. The outer surface of each dedicated waveguide component not contacted by the control button is then painted black to prevent other light from entering into the dedicated waveguide component. Light emitted by the LED reflects within the dedicated waveguide component until it exits the unpainted portion of the outer surface of the dedicated waveguide component. Specifically, light transmission from the waveguide component to the button occurs primarily from the hole perimeter surface 98 in the waveguide through which the button lightpipe/switch actuator feature passes. Some or all of the upper contact areas between the button and the waveguide component may be free of paint in order to facilitate additional light transmission. A light leak gasket (not shown) positioned between the chassis and the waveguide components may be used to prevent optical coupling between neighboring discrete backlit elements from stray light. The light then travels through the light-conducting interior of control button 92 and illuminates the symbology 100 thereon.

The invention as disclosed may be advantageously utilized in any backlit display where luminance output of control button symbology is highly desirable. Commercial and military avionics displays can take especial advantage of the invention because of the highly precise performance requirements of the environments in which displays are used. Land-based displays may also benefit from the invention.

The invention as herein described provides isolation of light sources to illuminate discrete symbololgy in display backlighting applications. An advantage of the invention is that variability in the luminance of emitted light from the control buttons in a keypanel can be easily eliminated after the keypanel has been fully assembled. Any variation in luminance from any control button with respect to other control buttons within the same illuminated panel can be eliminated by adjusting the output of its separate dedicated backlight system, via the LED driver and the microcontroller, without affecting the luminance of the other control buttons. Without isolation and backlight system autonomy, this adjustment is impossible regardless of technology and backlight drive control approach.

Another advantage of the invention is the reduction in the number of lighting sources required to backlight a keypanel. Instead of known redundant lighting sources, highly reliable LEDs make it possible to require as few as a single light source per keypanel control button.

Another advantage is that the time and expense of adjusting luminance of lighting sources in a keypanel is dramatically reduced. Consistency in luminance adjusting is also ensured.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the invention of the present disclosure.

What is claimed is:

1. A keypanel assembly, comprising:

first and second light-emitting diodes (LEDs) attached to a printed wiring board;

first and second switches attached to the printed wiring board;

a first control button configured to actuate the first switch, the first control button permitting light from the first LED to pass through the first control button to an outer surface of the first control button to illuminate control symbology disposed thereon;

a second control button configured to actuate the second switch, the second control button permitting light from the second LED to pass through the second control button to an outer surface of the second control button to illuminate control symbology disposed thereon;

an isolating structure that prevents light emitted by the second LED from illuminating control symbology on the first control button, the isolating structure further preventing light emitted by the first LED from illuminating control symbology on the second control button; and a chassis, wherein the first and second control buttons are supported by the chassis and the printed wiring board, and wherein the isolating structure is a first and second cavity defined by the printed wiring board and the chassis, the first cavity disposed to permit light emitted by the first LED to travel only through the first control button, and wherein the second cavity is disposed to permit light emitted by the second LED to travel only through the second control button, and wherein output luminance of the first LED and the second LED are isolated and independently controllable.

2. The keypanel assembly of claim 1, wherein the first and second switches are configured for light to pass therethrough, and wherein the isolating structure is a substantially opaque gasket that only permits light emitted by the first LED and passing through the first switch to pass through the first control button, and further only permits light emitted by the second LED and passing through the second switch to pass through the second control button.

3. The keypanel assembly of claim 1, wherein the isolating structure comprises first and second solid waveguide elements, wherein the first solid waveguide element is configured to reflect light emitted by the first LED to the first control button, and wherein the second solid waveguide element is configured to reflect light emitted by the second LED to the second control button.

4. The keypanel assembly of claim 3, wherein the first and second solid waveguide elements are mechanically connected.

5. The keypanel assembly of claim 1, further including an LED driver that controls output luminance of the first LED and the second LED, wherein the LED driver separately controls output luminance of the first LED and the second LED.

6. A keypanel assembly, comprising:

first and second light-emitting diodes (LEDs) attached to a printed wiring board;

first and second switches attached to the printed wiring board;

a first control button configured to actuate the first switch, the first control button permitting light from the first LED to pass through the first control button to an outer surface of the first control button to illuminate control symbology disposed thereon;

a second control button configured to actuate the second switch, the second control button permitting light from the second LED to pass through the second control button to an outer surface of the second control button to illuminate control symbology disposed thereon; and an isolating structure that prevents light emitted by the second LED from illuminating control symbology on the first control button, the isolating structure further preventing light emitted by the first LED from illuminating control symbology on the second control button;

wherein the isolating structure comprises first and second solid waveguide elements, wherein the first solid waveguide element is configured to reflect light emitted by the first LED to the first control button, and wherein the second solid waveguide element is configured to reflect light emitted by the second LED to the second control button, and wherein output luminance of the first LED and the second LED are isolated and independently controllable.

7. The keypanel assembly of claim 6, further including a chassis, wherein the first and second control buttons are supported by the chassis and the printed wiring board, and wherein the isolating structure is a first and second cavity defined by the printed wiring board and the chassis, the first cavity disposed to permit light emitted by the first LED to travel only through the first control button, and wherein the second cavity is disposed to permit light emitted by the second LED to travel only through the second control button.

8. The keypanel assembly of claim 6, wherein the first and second switches are configured for light to pass therethrough, and wherein the isolating structure is a substantially opaque gasket that only permits light emitted by the first LED and passing through the first switch to pass through the first control button, and further only permits light emitted by the second LED and passing through the second switch to pass through the second control button.

9. The keypanel assembly of claim 6, wherein the first and second solid waveguide elements are mechanically connected.

10. The keypanel assembly of claim 6, further including an LED driver that controls output luminance of the first LED and the second LED, wherein the LED driver separately controls output luminance of the first LED and the second LED.

* * * * *